United States Patent [19]

Hollingsworth et al.

[11] 4,375,622

[45] Mar. 1, 1983

[54] MULTIPORT RADIO FREQUENCY SIGNAL COMBINER

[75] Inventors: Allen H. Hollingsworth; Alan G. Deutschle, both of Hoffman Estates, Ill.

[73] Assignee: Motorola, Inc.

[21] Appl. No.: 255,408

[22] Filed: Apr. 20, 1981

[51] Int. Cl.[3] ..... H01P 5/12

[52] U.S. Cl. ..... 333/126; 333/127; 333/136

[58] Field of Search ..... 333/101, 104, 105, 120, 333/126, 127, 129, 134, 136, 263, 128; 370/38; 455/103

[56] References Cited

U.S. PATENT DOCUMENTS

| | | | |
|---|---|---|---|
| 2,428,831 | 10/1947 | Brown et al. | 333/127 |
| 2,478,920 | 8/1949 | Hansell | 333/101 X |
| 2,584,162 | 2/1952 | Sensiper et al. . | |
| 3,010,082 | 11/1961 | Budenbom . | |
| 3,066,291 | 11/1962 | Alford | 333/128 X |
| 3,156,879 | 11/1964 | Hess . | |
| 3,223,947 | 12/1965 | Clar | 333/104 |
| 3,428,920 | 2/1969 | Oleksiak . | |
| 3,503,014 | 3/1970 | Hall et al. | 333/104 |
| 3,619,787 | 11/1971 | Salzberg . | |
| 3,662,285 | 5/1972 | Rucker . | |
| 3,728,731 | 4/1973 | Choi et al. . | |
| 4,081,768 | 3/1978 | Voss et al. . | |

OTHER PUBLICATIONS

"Dissipative Loss in Bandpass Filters" by Allen Hollingsworth, published in Correlations, an Engineering Bulletin from Motorola, Inc., Fall 1979.

"Antenna System & Transmitter Combiners" by Wm. B. Bryson, published in Communications Magazine, Part I, Nov. 1980, and Part II, Dec. 1980 and Part III, Jan. 1981.

"Transmitter Multiplexing System in UHF Mobile Radio" by Kiyoshi Uenishi et al., IEEE Transactions on Vehicular Technology, vol. VT-18, No. 1, May 1969.

Microlab/FXR Catalog 25, Livingston, New Jersey.

*Primary Examiner*—Paul L. Gensler

*Attorney, Agent, or Firm*—Rolland R. Hackbart; James W. Gillman

[57] ABSTRACT

A multiport radio frequency (RF) signal combiner is described for combining three or more RF signals for application to an antenna. The combiner includes an input port for each RF signal, an output port coupled to the antenna, and a tuning port coupled to a tuning transmission line. The input ports, output port and tuning port are connected to a terminating element. The tuning transmission line is terminated by a fixed or adjustable short-circuit impedance for substantially eliminating the capacitive discontinuity created by interconnecting the input ports. The RF signal combiner can be advantageously utilized in any radio system where it is necessary to multiplex the RF signals from three or more transmitters to a single antenna.

23 Claims, 4 Drawing Figures

MULTIPORT RADIO FREQUENCY SIGNAL COMBINER

BACKGROUND OF THE INVENTION

The present invention relates generally to radio frequency (RF) signal combiners, and more particularly to a multiport RF signal combiner for combining a plurality of RF signals for transmission by a single antenna.

In radio systems, it is often desirable to combine a number of RF signals so that they may be transmitted by a single antenna. Separate antennas may be used for each RF signal provided each antenna is spatially isolated with respect to the other. However, when it is necessary to transmit three or more RF signals from one site, the use of separate, spatially isolated antennas, becomes impractical.

In order to combine a number of RF signals from radio transmitters and couple them to a common antenna, each transmitter must be isolated from one another to prevent intermodulation and possible damage to the transmitters. Two types of conventional combiners have been utilized in radio systems for combining RF signals from a number of transmitters. One type of combiner utilizes tunable devices, such as the hybrids and duplexers described in an article by William B. Bryson, entitled "Antenna Systems and Transmitter Combiners", Part III, published in Communications, Jan. 1981, pages 44–46, 48–50, 79, 80, and 82. These tunable devices typically accept two RF signals which are combined to provide a common output. In order to combine more than two RF signals, the tunable devices must be cascaded. Thus, not only do these tunable devices require precise manual tuning, but also incur additional RF signal losses and expense when cascaded to accommodate three or more radio signals.

Another type of conventional radio signal combiner typically includes an isolator and cavity filter for each RF signal transmitter and a combiner for interconnecting the RF signals from each of the cavity filters. However, the combiner in such combining systems terminates each transmitter with a capacitive discontinuity. The capacitive discontinuity can be alleviated to some degree by connecting the output of the combiner to an impedance adjuster, utilizing precisely located stubs for cancelling the capacitive discontinuity. One such impedance adjuster is described in an article entitled "Transmitter Multiplexing System in UHF Mobile Radio", by K. Uenishi, K. Araki and H. Ishii, published in the IEEE Transactions in Vehicular Technology, Vol. VT-18, No. 1, May, 1969, at pp. 1–11. However, the use of an impedance adjuster does not adequately cancel the capacitive discontinuity introduced by the combiner, since the impedance adjuster is located on the output transmission line, physically displaced from the actual interconnection. Thus, neither of the foregoing conventional combiners is suitable for combining three or more RF signals, while minimizing RF signal attenuation and capacitive discontinuities.

SUMMARY OF THE INVENTION

Accordingly, it is an object of the present invention to provide an improved and inexpensive RF signal combiner that combines three or more RF signals having different predetermined frequencies to provide a composite output signal.

It is another object of the present invention to provide an improved RF signal combiner that minimizes the capacitive discontinuity due to interconnecting three or more RF signals to be combined.

It is yet another object of the present invention to provide an improved RF signal combiner that may be easily tuned to a selected frequency band by varying the length of a tuning transmission line terminated by an open circuit or short circuit impedance.

It is yet a further object of the present invention to provide an improved RF signal combiner that accommodates a broad frequency bandwidth while introducing very little attenuation to each RF signal to be combined.

Briefly described, the present invention is a combiner for three or more RF signals having different predetermined frequencies. The combiner provides a composite output signal which may be coupled to an antenna. The combiner includes an input transmission line for each RF signal to be combined, and an output transmission line for providing the composite output signal. Each of the input transmission lines are disposed in the same plane and radially connected to a terminating element. The output transmission line is disposed perpendicular to the plane of the input transmission lines and is likewise connected to the terminating element. The combiner also includes a tuning transmission line terminated by a predetermined impedance, such as, for example, a short-circuit or open-circuit impedance. The tuning transmission line is connected to the terminating element for electrically terminating each of the input transmission lines with a substantially reactive impedance. Thus, the tuning transmission line substantially eliminates the capacitive discontinuity introduced when interconnecting three or more of the input transmission lines.

BRIEF DESCRIPTION OF THE DRAWINGS

FIGS. 3A and 3B taken together illustrate two embodiments of the combiner in FIG. 1, which are multiplexed to an antenna.

DETAILED DESCRIPTION OF THE PREFERRED EMBODIMENT

Figure 1:
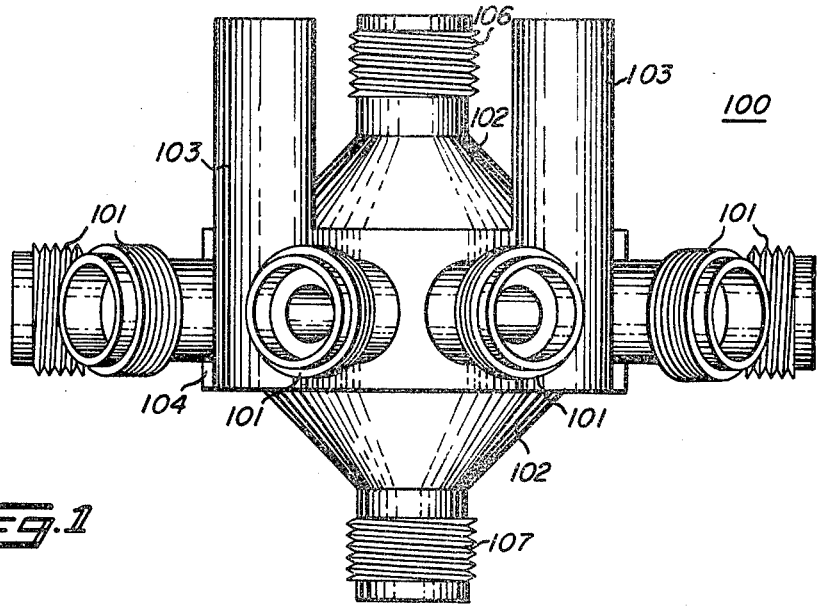
FIG. 1 is a perspective view of a multiport combiner embodying the present invention.

In FIG. 1, there is shown a perspective view of a multiport combiner 100 embodying the present invention. The combiner 100 includes ten input ports 101 emanating from a center portion 104, an output port 106 and a tuning port 107. Since combiner 100 is symmetrical, connections to the input ports 101, and likewise to either the output port 106 or the tuning port 107, are interchangeable. Four support members 103 are provided so that the combiner 100 may be bolted to a support panel (not shown). Top and bottom portions 102 of the combiner are identical and removable, being held in place by mounting screws.

Figure 2:
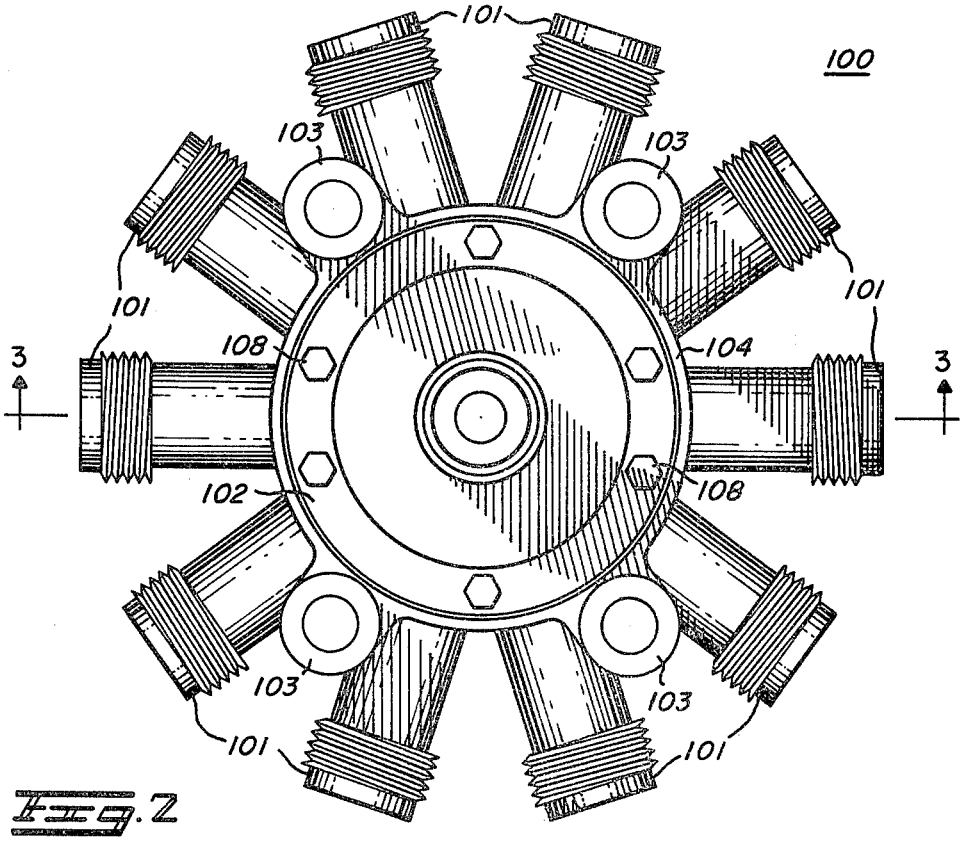
FIG. 2 is a top view of the center portion of the combiner in FIG. 1.
Figure 7A:
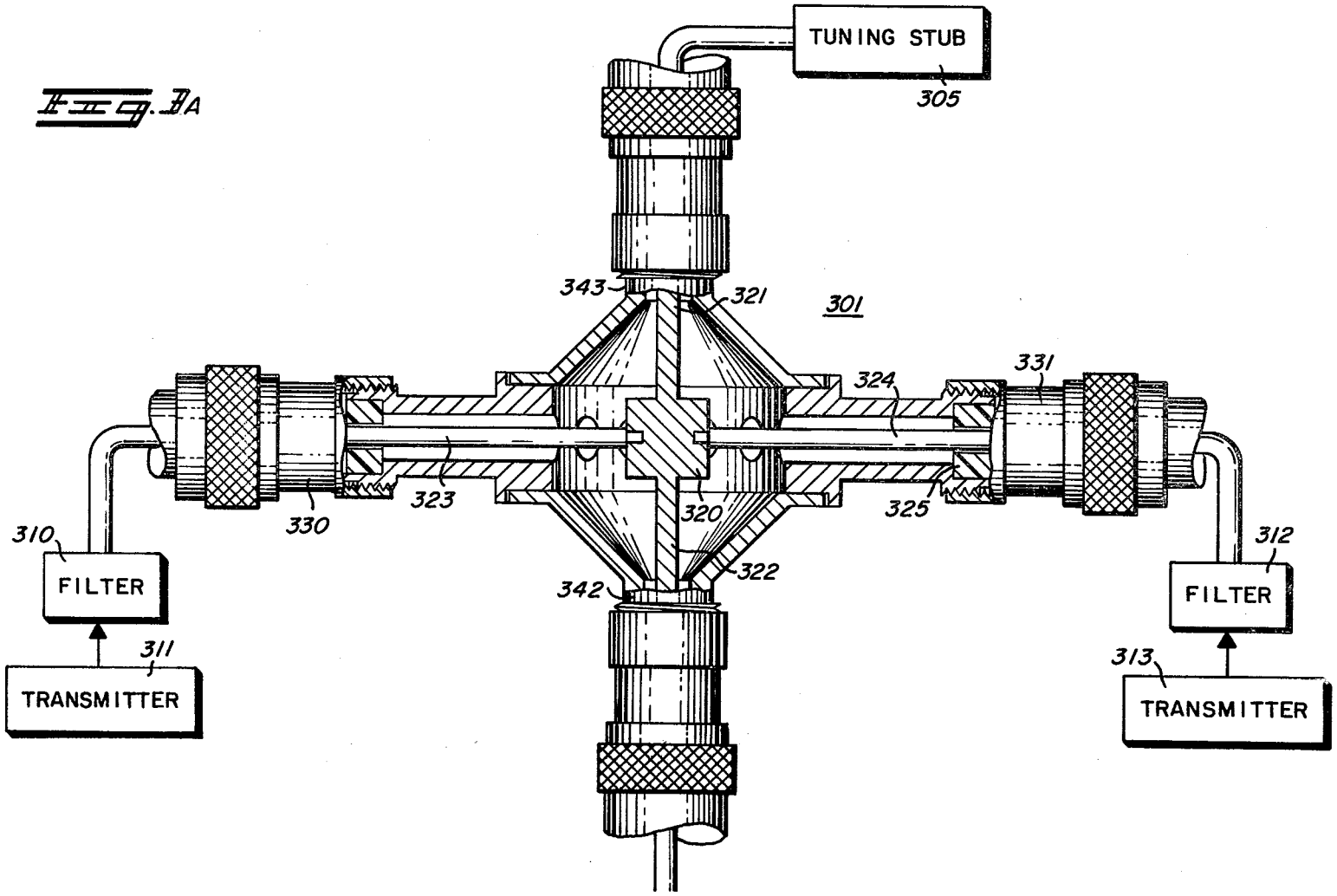

A top view of combiner 100 in FIG. 1 is shown in FIG. 2. The ten input ports 101 are symmetrically disposed about the periphery of the center portion 104. Although ten input ports 101 are shown in FIG. 2, any number of input ports may be utilized in practicing the present invention, the only practical limit being physical constraints. FIG. 2 also more clearly shows the mounting members 103. Six screws 108 insert into threaded holes for mounting the top and bottom portions 102 in FIG. 1 to the center portion 104.

Figure 3B:
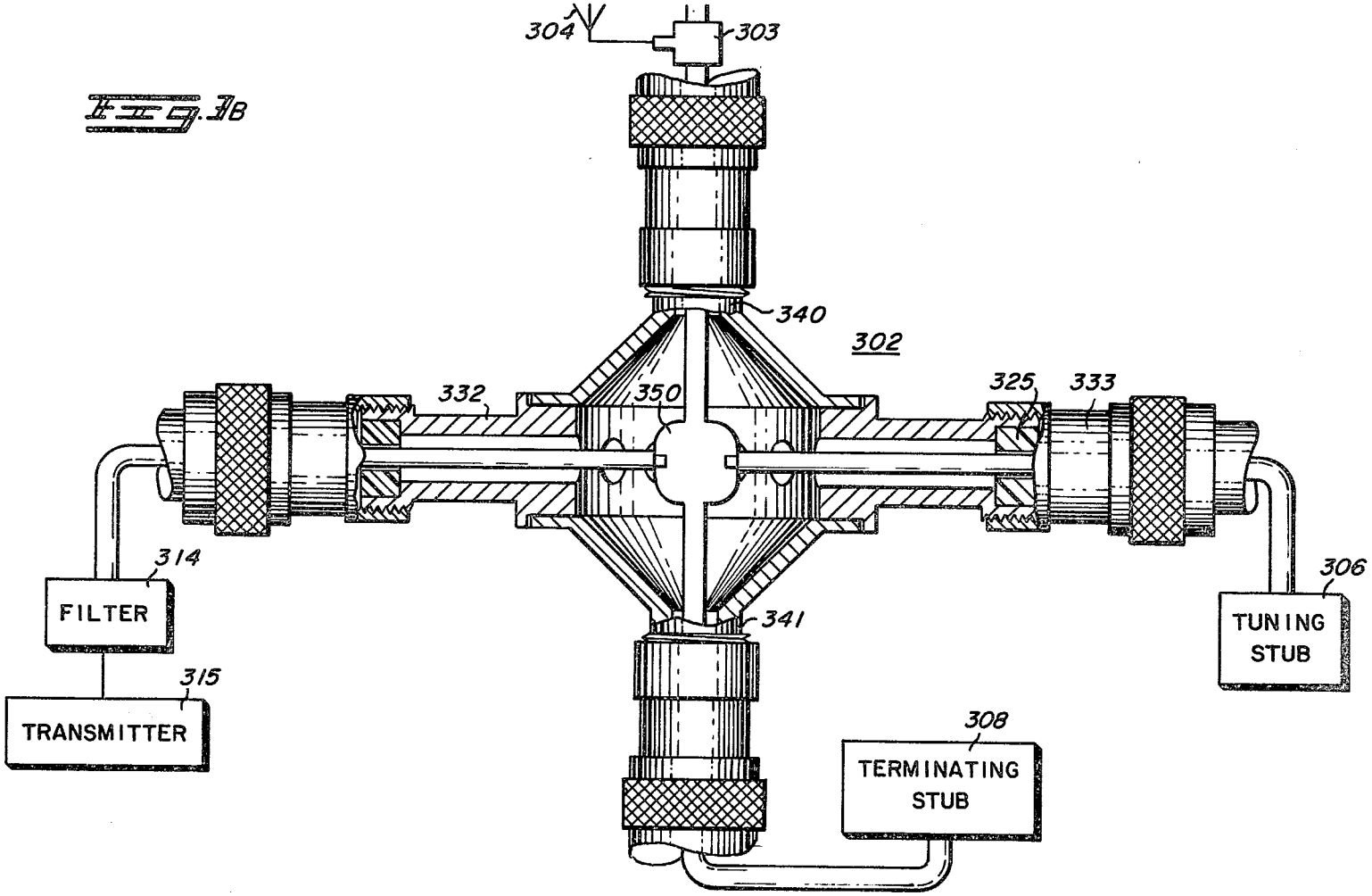

Referring to FIGS. 3A and 3B, there is illustrated two multiport combiners 301 and 302, whose output ports 342 and 340 are multiplexed by a conventional T-connector 303 to antenna 304. T-connector 303 is used when more than ten transmitters 311, 313 and 315 need to be coupled to a single antenna 304. If ten or less transmitters are to be coupled to antenna 304, only one combiner 301 or 302 is needed and therefore can be connected directly to antenna 304. The cross section of combiners 301 in FIG. 3A and 302 in FIG. 3B has been taken along lines 3—3 of the combiner in FIG. 2. Input ports 330 and 331 of combiner 301 in FIG. 3A and input port 332 of combiner 302 in FIG. 3B are connected to corresponding filters 310, 312 and 314 and transmitters 311, 313 and 315, respectively. The filters 310, 312 and 314 may typically be conventional cavity filters. To provide greater intermodulation protection to transmitters 311, 313 and 315, filters 310, 312 and 314 may each include a cavity filter and an isolator. Each of the filters 310, 312 and 314 are coupled to corresponding ports 330, 331 and 332 by equal lengths of transmission line in order to minimize reflections and RF signal loss. The exact lengths of these interconnecting transmission lines can be readily determined by conventional transmission line design techniques once the RF signal frequency range is selected. Tuning port 343 of combiner 301 in FIG. 3A and tuning port 333 of combiner 302 in FIG. 3B are coupled to conventional tuning transmission lines or stubs 305 and 306, respectively. Tuning transmission lines 305 and 306 may be any conventional fixed on adjustable transmission lines, such as the SO series adjustable short-circuit transmission lines manufactured by Microlab/FXR, Livingston, New Jersey.

The input ports 330 and 331, the output port 342 and the tuning port 343 of combiner 301 in FIG. 3A are coupled to terminating element 320 by means of conductors 323, 324, 322 and 321, respectively. According to an important feature of the present invention, terminating element 320 and conductors 321 and 322 may be a single element formed of a suitable conductive material. Providing terminating element 320 and conductors 321 and 322 as a single element not only reduces the number of elements in combiner 301, but also facilitates the assembly of combiner 301. The shape of terminating element 320 can vary depending on the number of input ports to be terminated. For example, the preferred embodiment of terminating element 320 has a cylindrical shape for terminating the ten input ports 101 of combiner 100 in FIG. 1. If there are four or less input ports, terminating element 320 may have a cubical shape. Also, the terminating element may have a spherical shape as illustrated by terminating element 350 of combiner 302 in FIG. 3B. Holes are provided in terminating elements 320 and 350 for facilitating connection of the conductors of the input ports. The input conductors may be affixed to terminating elements 320 and 350 by any suitable means, such as by soldering.

To further facilitate assembly of the combiners 301 in FIG. 3A and 302 in FIG. 3B, a bushing 325 is inserted into each port for properly orienting the conductor therein. In assembling the combiner, input conductors and bushings are first installed into each port of the middle portion 104 and top and bottom portions 102 in FIG. 1. Next, the input conductors are arranged so as to engage corresponding holes in the terminating element 320 or 350 and then soldered to the engaged terminating element. After the input conductors have been installed, the top and bottom portions 102 may then be screwed onto the center portion 104 of the combiner. Thus, the inventive combiner can be quickly and easily assembled.

Since the combiner of the present invention is symmetrical, tuning transmission lines or stubs 305 and 306 may be coupled to any selected port of combiners 301 and 302. For example, tuning transmission line 305 is coupled to port 343 of combiner 301 in FIG. 3A, while tuning transmission line 306 is coupled to port 333 of combiner 302 in FIG. 3B. Also, unused ports, such as port 341 in FIG. 3B, may be connected to a conventional terminating transmission line 308. For example, terminating transmission line 308 may be terminated by a short circuit impedance and have a length such that port 341 presents an open-circuit impedance at terminating element 350. The length of the terminating transmission line 308 can be readily determined by transmission line design techniques described in conventional text books such as, "Transmission lines and Wave Propagation", by Philip C. Magnusson, Allyn and Bacon, Inc., Boston 1965.

According to an important feature of the present invention, tuning transmission lines 305 and 306 are connected directly to corresponding terminating elements 320 and 350 so that the capacitive discontinuity introduced by interconnecting three or more input ports can be substantially eliminated. Moreover, the inventive combiner can be readily adapted to accommodate different frequency ranges of RF signals simply by appropriately adjusting tuning stubs 305 and 306. Furthermore, tuning stubs 305 and 306 can be readily interchanged since they can be attached to combiners 301 and 302, respectively, by means of conventional coaxial connectors.

Each transmitter 311 and 313 in FIG. 3A and 315 in FIG. 3B generates an RF signal at a unique frequency, and each filter 310, 312 and 314 is tuned to pass the RF signal signal from the corresponding transmitter. Therefore, an RF signal from one transmitter is not loaded by the filter and transmitter of the other ports since each of the other filters is tuned to a different frequency. As a result, the combiner of the present invention is essentially lossless. Furthermore, the inventive combiner has a wide bandwidth. For example, a combiner 100 embodying the present invention tuned for combining RF signals in the 870-890 mHz frequency band exhibits a 3 dB bandwidth of approximately 420 MHz.

In summary a unique RF signal combiner has been described which combines three or more RF signals for application to an antenna. The unique RF signal combiner substantially eliminates the capacitive discontinuity created by interconnecting three or more RF signals at a single point. The capacitive discontinuity is substantially eliminated by means of a tuning transmission line which is connected directly to the terminating element interconnecting each of the RF signals to be combined. Since the tuning transmission line can be readily adjusted or interchanged, the inventive combiner can be easily adapted to accommodate any desired frequency band of RF signals.

We claim:

1. Apparatus for combining at least three radio frequency signals, having different predetermined frequencies and being generated by separate signal sources, to provide a composite output signal, comprising:

a plurality of input transmission line means each having a signal conductor and a predetermined characteristic impedance, disposed in the same plane with one another and coupled to a corresponding one of the radio frequency signals;

output transmission line means having a signal conductor and a predetermined characteristic impedance and providing the composite output signal;

a terminating element for commonly interconnecting at substantially a single point the signal conductors of the input transmission line means and the signal conductor of the output transmission line means and combining the radio frequency signals on the signal conductors of the input transmission line means to provide the composite output signal on the signal conductor of the output transmission line means, each of the signal conductors of the input transmission line means radially connected to the terminating element, and the signal conductor of the output transmission line means disposed perpendicular to the plane of the signal conductors of the input transmission line means; and tuning transmission line means having a signal conductor and a predetermined characteristic impedance and being terminated by a predetermined impedance, the signal conductor of the tuning transmission line means connected to the terminating element substantially at the single interconnection point for substantially eliminating the effects of the capacitive discontinuity created at the interconnection point.

2. The combining apparatus according to claim 1, wherein the tuning transmission line means is terminated by a short-circuit impedance.

3. The combining apparatus according to claim 1, wherein the tuning transmission line means is terminated by an open-circuit impedance.

4. The combining apparatus according to claim 1, wherein said tuning transmission line means is disposed in the same plane as the input transmission line means.

5. The combining apparatus according to claim 1, wherein the tuning transmission line means is disposed perpendicular to the plane of the input transmission line means.

6. The combining apparatus according to claim 1, wherein the terminating element has a cylindrical shape and is comprised of an electrically conductive material.

7. The combining apparatus according to claim 1, wherein the terminating element has a circular shape and is comprised of an electrically conductive material.

8. The combining apparatus according to claim 4, wherein the terminating element has a cylindrical shape and is comprised of an electrically conductive material, the cylindrically shaped terminating element having parallel top and bottom surfaces and a radial surface, the plurality of input and the tuning transmission line means connected to the radial surface of the cylindrical terminating element, and the output transmission line means coupled to one of the top and bottom surfaces.

9. The combining apparatus according to claim 5, wherein the terminating element has a cylindrical shape and is comprised of an electrically conductive material.

10. The combining apparatus according to claim 9, wherein the cylindrically shaped terminating element has parallel top and bottom surfaces and a radial surface, the plurality of input transmission line means each connected to the radial surface, the output transmission line means connected to one of the top and bottom surfaces, and the tuning transmission line means connected to the surface opposite said one of the top and bottom surfaces.

11. The combining apparatus according to claim 9, wherein the output transmission line means, tuning transmission line means and terminating element are integrally comprised of an electrically conductive material.

12. Apparatus for combining at least three radio frequency signals, having different predetermined frequencies, to provide a composite output signal, comprising:

a plurality of transmitting means each for generating a radio frequency signal having a predetermined frequency;

a plurality of filtering means each coupled to one of the transmitting means for filtering the radio frequency signal therefrom;

a plurality of input transmission line means each having a signal conductor and a predetermined characteristic impedance, disposed in the same plane with one another and coupled to one of the filtered radio frequency signals from the filtering means;

output transmission line means having a signal conductor and a predetermined characteristic impedance and providing the composite output signal;

a terminating element for commonly terminating at substantially a single point the signal conductors of the input transmission line means and the signal conductor of the output transmission line means and combining the radio frequency signals on the signal conductors of the input transmission line means to provide the composite output signal on the signal conductor of the output transmission line means, each of the signal conductors of the input transmission line means radially connected to the terminating element, and the signal conductor of the output transmission line means disposed perpendicular to the plane of the signal conductors of the input transmission line means; and tuning transmission line means having a signal conductor and a predetermined characteristic impedance and being terminated by a predetermined impedance, the signal conductor of the tuning transmission line means connected to the terminating element substantially at the single interconnection point for substantially eliminating the effects of the capacitive discontinuity created at the interconnection point.

13. The combining apparatus according to claim 12, wherein the tuning transmission line means is terminated by a short-circuit impedance.

14. The combining apparatus according to claim 12, wherein the tuning transmission line means is terminated by an open-circuit impedance.

15. The combining appartus according to claim 12, wherein said tuning transmission line means is disposed in the same plane as the input transmission line means.

16. The combining apparatus according to claim 12, wherein the tuning transmission line means is disposed perpendicular to the plane of the input transmission line means.

17. The combining apparatus according to claim 12, wherein the terminating element has a cylindrical shape and is comprised of an electrically conductive material.

18. The combining apparatus according to claim 12, wherein the terminating element has a circular shape and is comprised of an electrically conductive material.

19. The combining apparatus according to claim 15, wherein the terminating element has a cylindrical shape and is comprised of an electrically conductive material, the cylindrically shaped terminating element having parallel top and bottom surfaces and a radial surface, the plurality of input and the tuning tranmission line means connected to the radial surface of the cylindrical terminating element, and the output transmission line means coupled to one of the top and bottom surfaces.

20. The combining apparatus according to claim 16, wherein the terminating element has a cylindrical shape and is comprised of an electrically conductive material.

21. The combining apparatus according to claim 20, wherein the cylindrically shaped terminating element has parallel top and bottom surface and a radial surface, the plurality of input transmission line means each connected to the radial surface, the output transmission line means connected to one of the top and bottom surfaces, and the tuning transmission line means connected to the surface opposite said one of the top and bottom surfaces.

22. The combining apparatus according to claim 20, wherein the output transmission line means, tuning transmission line means and terminating element are integrally comprised of an electrically conductive material.

23. The combining apparatus according to claim 12, further including antenna means coupled to the output transmission line means for radiating the composite signal.

* * * * *

UNITED STATES PATENT AND TRADEMARK OFFICE

CERTIFICATE OF CORRECTION

PATENT NO. : 4,375,622

DATED : March 1, 1983

INVENTOR(S) : Allen H. Hollingsworth and Alan G. Deutschle

It is certified that error appears in the above—identified patent and that said Letters Patent is hereby corrected as shown below:

Claim 21, column 7, line 15,- delete"top and bottom surface" and insert --top and bottom surfaces--

Signed and Sealed this

*Third* Day of *May 1983*

[SEAL]

*Attest:*

GERALD J. MOSSINGHOFF

*Attesting Officer*

*Commissioner of Patents and Trademarks*